US006288328B1

(12) United States Patent
Brake et al.

(10) Patent No.: US 6,288,328 B1
(45) Date of Patent: Sep. 11, 2001

(54) COAXIAL CABLE HAVING EFFECTIVE INSULATED CONDUCTOR ROTATION

(75) Inventors: Douglas R. Brake, Ralston, NE (US); Philip Nelson Gardner; Trent M. Hayes, both of Suwanee, GA (US); Paul G. Koehler; Dean J. Schwery, both of Omaha, NE (US); Stephen Taylor Zerbs, Gretna, NE (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/272,514

(22) Filed: Mar. 19, 1999

(51) Int. Cl.[7] ..... H01B 11/00
(52) U.S. Cl. ..... 174/28; 174/36; 174/102 R
(58) Field of Search ..... 174/28, 113 R, 174/36, 102 R

(56) References Cited

U.S. PATENT DOCUMENTS

| | | | | |
|---|---|---|---|---|
| 1,835,031 | | 12/1931 | Espenschied et al. . | |
| 4,515,992 | * | 5/1985 | Gupta | 174/102 R |
| 4,552,989 | * | 11/1985 | Sass | 174/103 |
| 4,894,488 | * | 1/1990 | Gupta | 174/28 |
| 5,500,488 | * | 3/1996 | Buckel | 174/102 R |
| 5,767,441 | * | 6/1998 | Brorein et al. | 174/27 |

FOREIGN PATENT DOCUMENTS

| | | |
|---|---|---|
| 1904322 | 12/1960 | (DE) . |
| 643250A | 9/1950 | (GB) . |

* cited by examiner

*Primary Examiner*—Dean A. Reichard
*Assistant Examiner*—William H Mayo, III
(74) *Attorney, Agent, or Firm*—Michael A. Morra; Thomas J. Bean

(57) ABSTRACT

A coaxial cable [10, 50] includes an inner conductor [11] that is separated from an outer conductor [13] by a layer of insulating material [12]. The outer conductor includes a thin sheet of metallic foil that envelops the insulating material and has a seam [14] that extends in the longitudinal direction of the cable. In a first embodiment, the insulated conductor is axially rotated (twisted) with respect to its own longitudinal axis. In a second embodiment, the outer conductor is wrapped around the layer of insulating material. In both embodiments, there is relative rotation between the insulated conductor and the outer conductor. This practice is referred to as relative insulated conductor rotation, and it significantly improves the structural return loss characteristics of a coaxial cable when the outer conductor includes an asymmetry, such as a seam, that extends in the longitudinal direction of the cable. A braided-wire shield [15] is positioned between the outer conductor and a plastic jacket [16], which provides environmental protection for the cable.

19 Claims, 3 Drawing Sheets

COAXIAL CABLE HAVING EFFECTIVE INSULATED CONDUCTOR ROTATION

TECHNICAL FIELD

This invention relates to the design of a coaxial cable and, in particular, to a coaxial cable having improved structural return loss.

BACKGROUND OF THE INVENTION

There appears to be a healthy competition developing between optical and electrical communication systems. If electrical systems are to remain viable for distributing signals at high transmission speeds, then electrical cables and connectors must improve their transmission performance or face replacement by optical systems. However, since nearly all consumer and business communication systems are equipped to handle electrical signals exclusively, electrical systems presently enjoy a competitive advantage. Nevertheless, the replacement of electrical equipment with optical equipment may ultimately occur anyway, but it can be forestalled for the foreseeable future by substantial performance improvements. Compared to optical cables, electrical cables suffer from limited broadband capability and have greater crosstalk susceptibility. One of the most efficient and widely used electrical cables, which has both broadband capability and immunity from crosstalk interference, is the well-known coaxial cable.

Coaxial cable was invented at Bell Laboratories on or before May 23, 1929 by Lloyd Espenschied and Herman Affel (see U.S. Pat. No. 1,835,03 1), and it seems unlikely after so many years that it might still be possible to improve its performance in any meaningful manner. Nevertheless, such improvement is sought.

Coaxial cable comprises an electrical conductor (hereinafter "inner" conductor) that is completely encircled by another electrical conductor (hereinafter "outer" conductor) with a non-conducting layer between them. The thickness of this layer is, ideally, uniform and may comprise air, but most often comprises a dielectric material such as polyethylene. Coaxial cables transmit energy in the TEM (Transverse Electromagnetic) mode, and have a cutoff-frequency of zero. In addition, it comprises a two-conductor transmission line having a wave impedance and propagation constant of an unbounded dielectric, and the phase velocity of the energy is equal to the velocity of light in an unbounded dielectric. Coaxial cable has other advantages that make it particularly suited for efficient operation in the HF (High Frequency) and UHF (Ultra High Frequency) regions of the electromagnetic spectrum. It is a perfectly shielded line and has a minimum of radiation loss. It may be made with a braided outer conductor for increased flexibility, and it is generally impervious to weather. Inasmuch as the coaxial cable has little radiation loss, nearby metallic objects and electromagnetic energy sources have minimum effect on the cable as the outer conductor serves as a shield for the inner conductor.

Asymmetrical imperfections such a ovality of the dielectric material, out-of-roundness (eccentricity) of the wire cross section, and lack of perfect centering of the wire within the dielectric material tend to limit the high-frequency performance of coaxial cables. These imperfections are practically unavoidable during manufacture for a variety of reasons including: tool wear, gravity, unequal flow of dielectric material during extrusion, tolerances, etc. As a result of such asymmetrical imperfections, a variety of transmission problems can arise including signal reflections (i.e., structural return loss), distortion, and loss of power. Variations in the electrical impedance of the coaxial cable at different points along its length, caused by minor changes in the distance between the inner and outer conductors, give rise to signal reflections. Such reflections shorten the distance that a signal can be transmitted along the coaxial cable without error, and limits the maximum frequency that can be supported.

In an attempt to improve the SRL (Structural Return Loss) performance of a coaxial cable, manufactures have employed a variety of different schemes focusing on concentricity and eccentricity of the central metallic conductor within the dielectric insulation. These schemes have not yet yielded sufficient improvement in a practical manufacturing environment and, accordingly, new techniques for improving SRL are desirable.

SUMMARY OF THE INVENTION

The foregoing problems have been overcome by a coaxial cable, which includes an inner metallic conductor separated from an outer metallic conductor by a layer of electrical insulation having a predetermined thickness. Most notably, in accordance with the present invention, the insulated inner conductor is effectively rotated about its longitudinal axis at a predetermined rate of revolution relative to the outer conductor. Such ICR (Insulated Conductor Rotation) significantly improves the structural return loss performance of the resulting cable.

In one illustrative embodiment of the present invention, the insulated conductor is rotated about its own longitudinal axis prior to the installation of a foil shield; whereas in another embodiment of the invention, the foil shield is helically wrapped around a non-rotated insulated conductor.

Although ICR has been used in connection with wire-pairs to reduce structural return loss, it was never considered applicable to coaxial cables because rotating the insulated conductor of a coaxial cable does not change the distance between the inner and outer conductors. However, what had been overlooked, until the present invention, is the fact that the outer conductor frequently includes a seam along its length. A significant aspect of the present invention is the discovery that this seam constitutes an asymmetry in the outer conductor structure that needs to be averaged with any asymmetry of the insulated central conductor using ICR to effectively reduce the structural return loss. Surprisingly, structural return loss is significantly reduced when ICR is employed. As might be expected, ICR does not improve a coaxial cable whose inner conductor is located precisely on the central axis of the cable, or whose outer conductor is perfectly circular along the entire length of the cable. But because perfection is such a rare commodity, ICR provides measurable improvement in most coaxial cables.

BRIEF DESCRIPTION OF THE DRAWING

Other objects and features of the present invention will be more readily understood from the following detailed description of specific embodiments thereof when read in conjunction with the accompanying drawings, in which.

DETAILED DESCRIPTION

Figure 1:
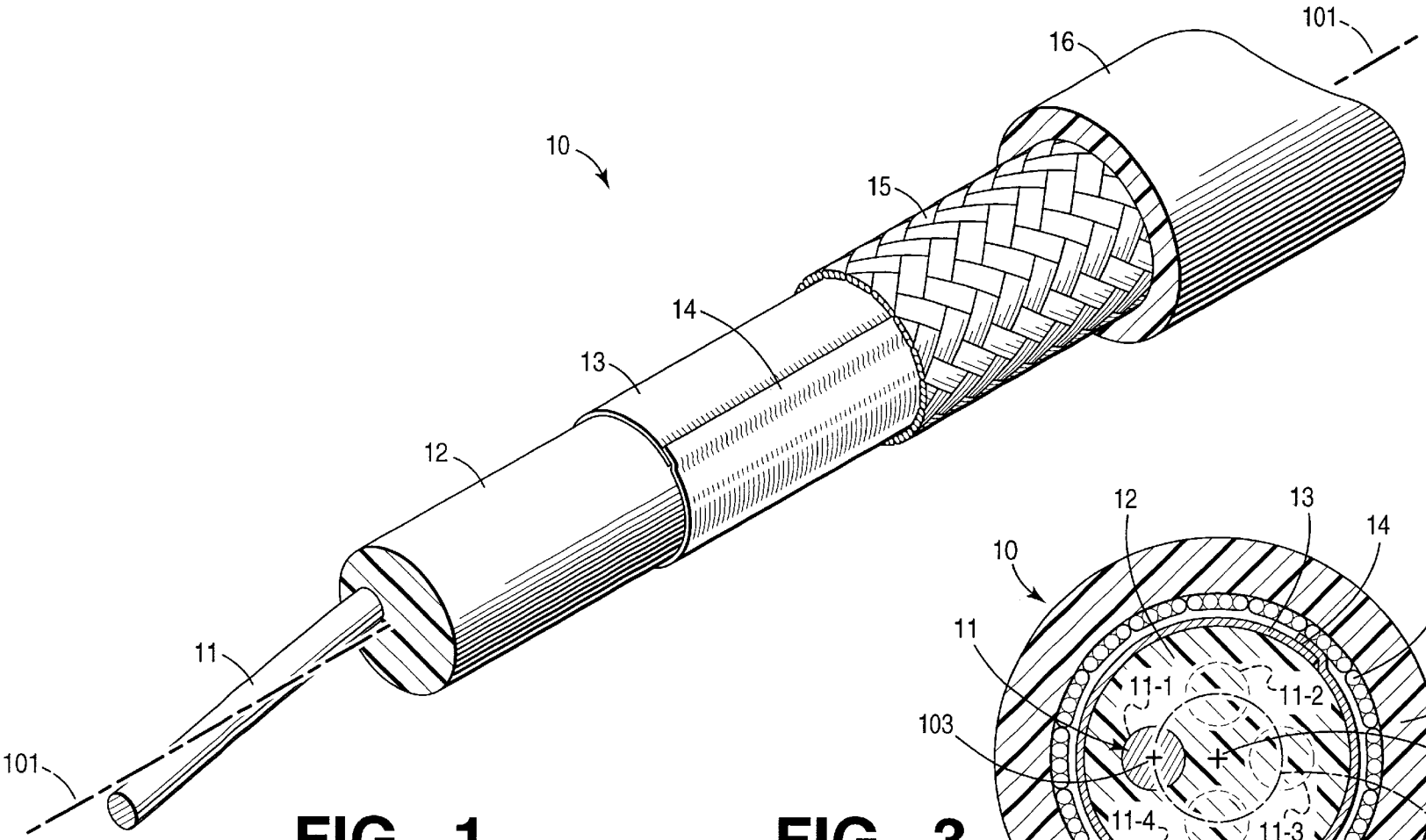
FIG. 1 is a perspective view of a coaxial cable in accordance with a first embodiment of the present invention.
Figure 3:
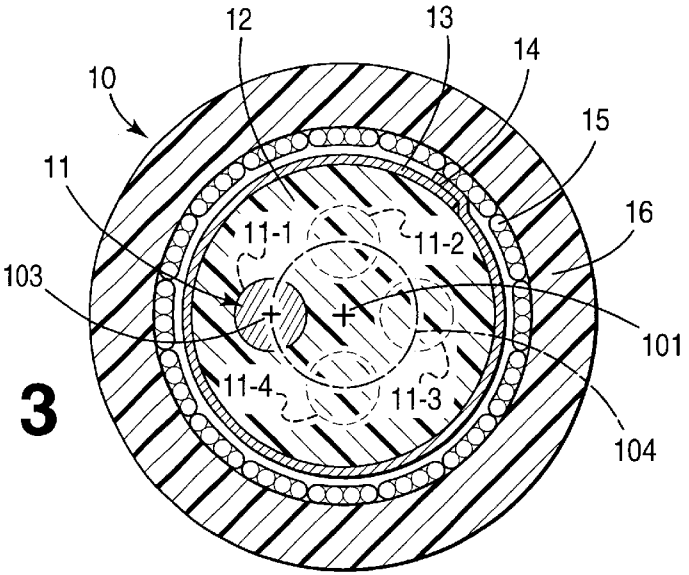
FIG. 3 discloses an end view of the coaxial cable of FIG. 1 showing the location of the inner conductor at various points along the cable.

Coaxial cable 10 of FIG. 1 and FIG. 3 discloses a first embodiment of the present invention and comprises an inner conductor 11 that is surrounded by a layer 12 of insulating material, which illustratively has an outside diameter of about 75 mils (i.e., 1.9 millimeters) and preferably comprises foamed high-density polyethylene. Illustratively, conductor 11 comprises 26 AWG (American Wire Gauge) copper wire that is plated with silver, and the foamed polyethylene has a dielectric constant of approximately 1.2. In accordance with the principles of the present invention, this insulated conductor structure 11, 12 is rotated around its central axis 101—101 in either the clockwise or counter-clockwise direction with a period spanning some length "L" of the conductor. Preferably, L (also known as the "rotation length" or "lay") is less that the period of the highest frequency to be carried by the conductor, although structural return loss (SRL) improvement has been observed at longer rotation lengths. Such rotation is hereinafter referred to as insulated conductor rotation (ICR), and it is applied to the insulated conductor structure 11, 12 prior to the installation of a metallic shield 13, which forms the outer conductor of coaxial cable 10. Illustratively, metallic shield 13 comprises a 2 mil (i.e., 0.05 millimeter) polyester-aluminum foil that is bonded along a seam.

In the past, insulated conductor rotation had been applied to wire pairs (see for example U.S. Pat. No. 5,767,441) but never to coaxial cables. This is because it is difficult to envision how ICR could benefit coaxial cables because of their symmetry, and because such rotation does not change the distance between the inner and outer conductors. However, what was overlooked was the existence of a seam 14 in the construction of the outer conductor 13. This seam 14 creates an asymmetry, which extends in the longitudinal direction of coaxial cable 10 and, surprisingly, degrades the SRL performance of the cable when it combines with asymmetries in the insulated conductor structure. And while this degradation is small in coaxial cables whose inner conductor is substantially coincident with the central axis of the cable, it has been found to add more than 6 dB of SRL improvement to those coaxial cables whose inner conductor measurably departs from the central axis of the cable along its length.

In a preferred embodiment of the present invention, a metallic braid 15 surrounds the outer conductor 13. Illustratively, the braid comprises a weave of 36 AWG tinned-copper or aluminum wires that are positioned between the outer conductor 13 and a protective plastic jacket 16, which is illustratively made from polyvinyl chloride (PVC) or polyethylene. Also in a preferred embodiment of the invention, the outer diameter of the cable 10 is relatively small (i.e., less than about 15 millimeters) in order to provide flexibility so that it can be installed easily.

While the general cable structure described above may relate to any number of high performance communication cable designs, the particular advantages of the present invention over the prior art is attributable to the novel teaching that purposely rotating the insulated central conductor of a coaxial cable, prior to applying the outer shield, significantly enhances the operational performance of the cable.

Figure 2:
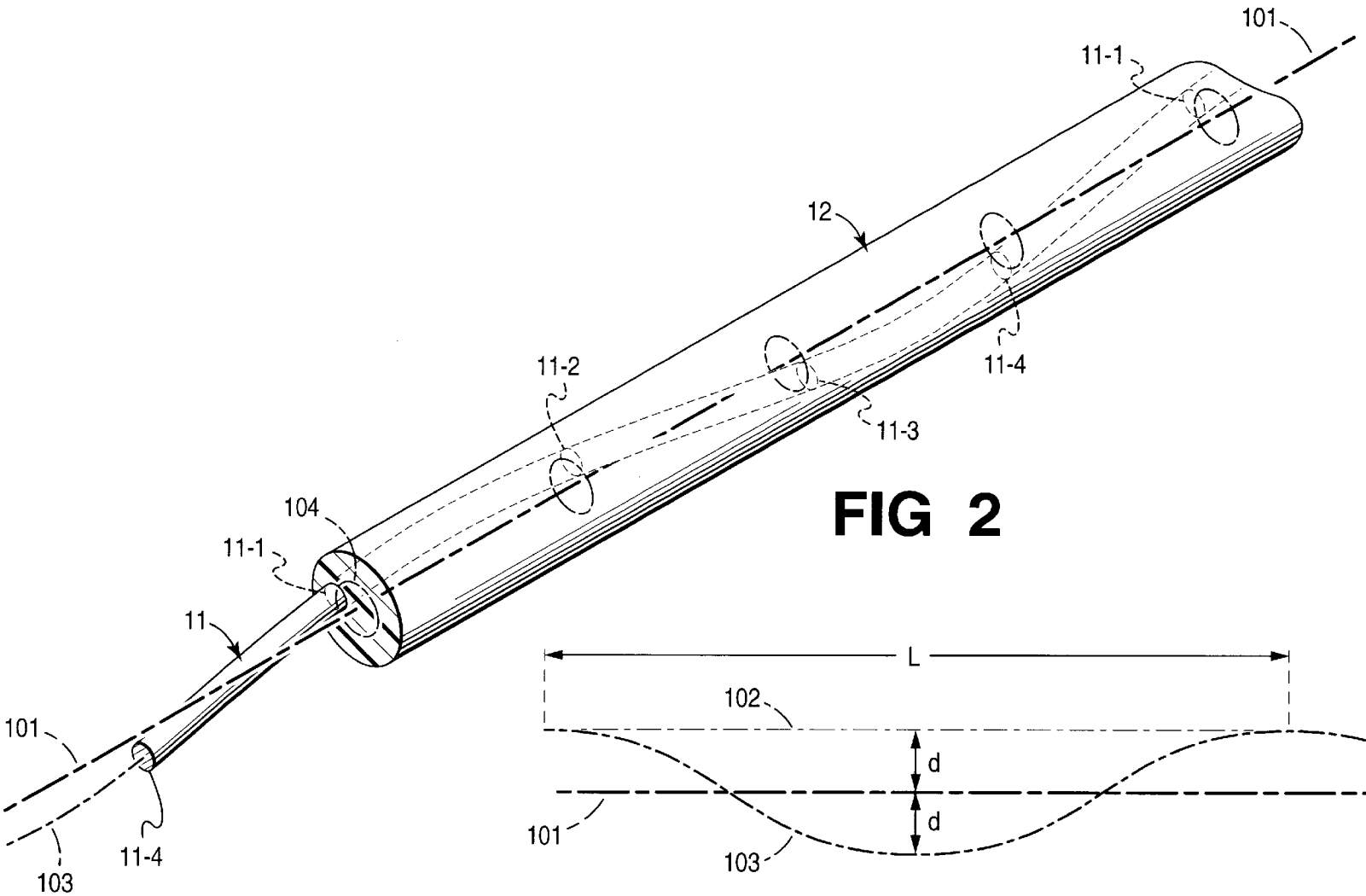
FIG. 2 illustrates the effect of ICR on the position of the inner conductor with respect to the central axis of the cable.

ICR is one effective way of nulling, or averaging out, the eccentricity of a conductor surrounded by a non-uniform layer of insulation, and it may be beneficial to consider specifically what is happening inside of a conductor during one period of ICR. Reference is therefore made to FIG. 2 and FIG. 3 which show an exaggerated view of a conductor 11 that is surrounded by insulating material 12 and rotated about the central axis 101 of the structure. The central axis 103 of conductor 11 is offset from the central axis 101 of the cable by a fixed distance. As the insulated conductor is rotated, a locus of points 104 is formed that encircles the central axis 101. The position of the inner conductor 11 within the insulating material 12 is shown by dotted lines (11-1, 11-2, 11-3, 11-4) at various locations along the cable in order to demonstrate that ICR moves the inner conductor 11 around the central axis 101 of the cable. As a result, an electrical signal traversing the length of the rotated conductor will effectively behave (electrically) as though it were perfectly concentric. In other words, a coaxial conductor having been rotated in accordance with the teachings of the present invention is practically identical to a coaxial conductor having perfect concentricity, or zero eccentricity.

Figure 4:
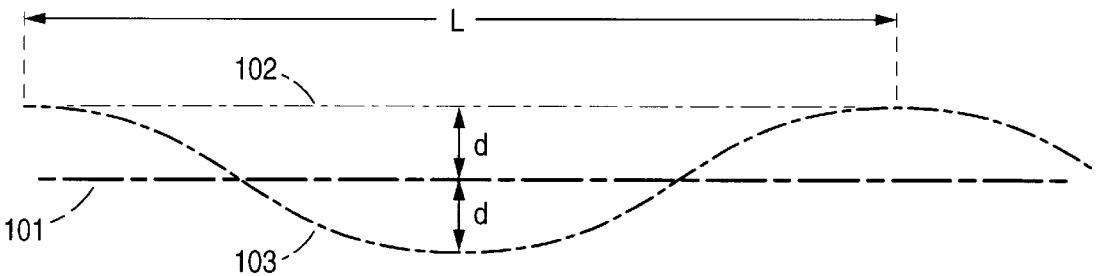
FIG. 4 illustrates the effect of ICR upon the central axis of the inner conductor with respect to the central axis of the cable.

FIG. 4 illustrates the effect of ICR upon the longitudinal axis 103 of the inner conductor with respect to the longitudinal axis 101 of the cable. In particular, FIG. 4 is a side view of the coaxial cable with only various longitudinal axes shown. Axis 102 represents the longitudinal axis of the inner conductor prior to rotation. Note that axis 102 is displaced from the longitudinal axis 101 of the cable by a distance, d. It is this displacement that interacts with asymmetries in the outer conductor to degrade SRL. By rotating the insulated conductor around its own longitudinal axis one time for every length L of conductor, the average distance between the longitudinal axis of the conductor 103 and the longitudinal axis of the cable 101 becomes zero and SRL is advantageously decreased. Such rotation is accomplished prior to the installation of the outer conductor, and this step is frequently referred to as "pre-twisting." It is understood that ICR can be used on coaxial cables of all diameters; however, practical considerations limit the minimum value of L. Smaller cables can handle smaller values of L for the same strain imposed on the insulated conductor. Naturally, smaller values of L provide SRL improvement at higher frequencies. Nevertheless, the actual value of L is a matter of design choice.

In accordance with the present invention, ICR can be accomplished by a number of techniques. One such technique involves using a vertical twister (twinner), commonly used to twist two insulated conductors into a conductor-pair. More specifically, in order to implement ICR, a single insulated conductor is processed through the vertical twister in the conventional manner. Depending on the particular manufacturing set-up of the particular twister at hand, various mechanical adjustments may need to be made; however any such adjustments are believed to be fully within the capabilities of one of ordinary skill in the art and therefore are not specifically discussed herein. As noted above, other existing equipment may also be suitable to implement ICR in accordance with the present invention, including but not limited to a horizontal twinner.

The preferred ICR length, L, based on practical considerations for the above-identified dimensions of the cable is about 5 inches (i.e., 12.7 centimeters). Moreover, improvement has been measured with L equal to one meter because significant information is transmitted over coaxial cables at frequencies at or below 100 MHz. Nevertheless, ICR may be applied at a rotational rate that varies over the length of the cable and in a direction that changes from clockwise to counter-clockwise over the length of the cable.

From an operational standpoint, ICR may provide at least the following improvements to existing coaxial cable designs: (i) increased SRL margin (e.g., about 6 dB) that enables the cable to meet enhanced transmission requirements; (ii) increased insertion loss margin (e.g., about 1%); and (iii) decreased quality and/or quantity requirements of the insulating materials.

Figure 5:
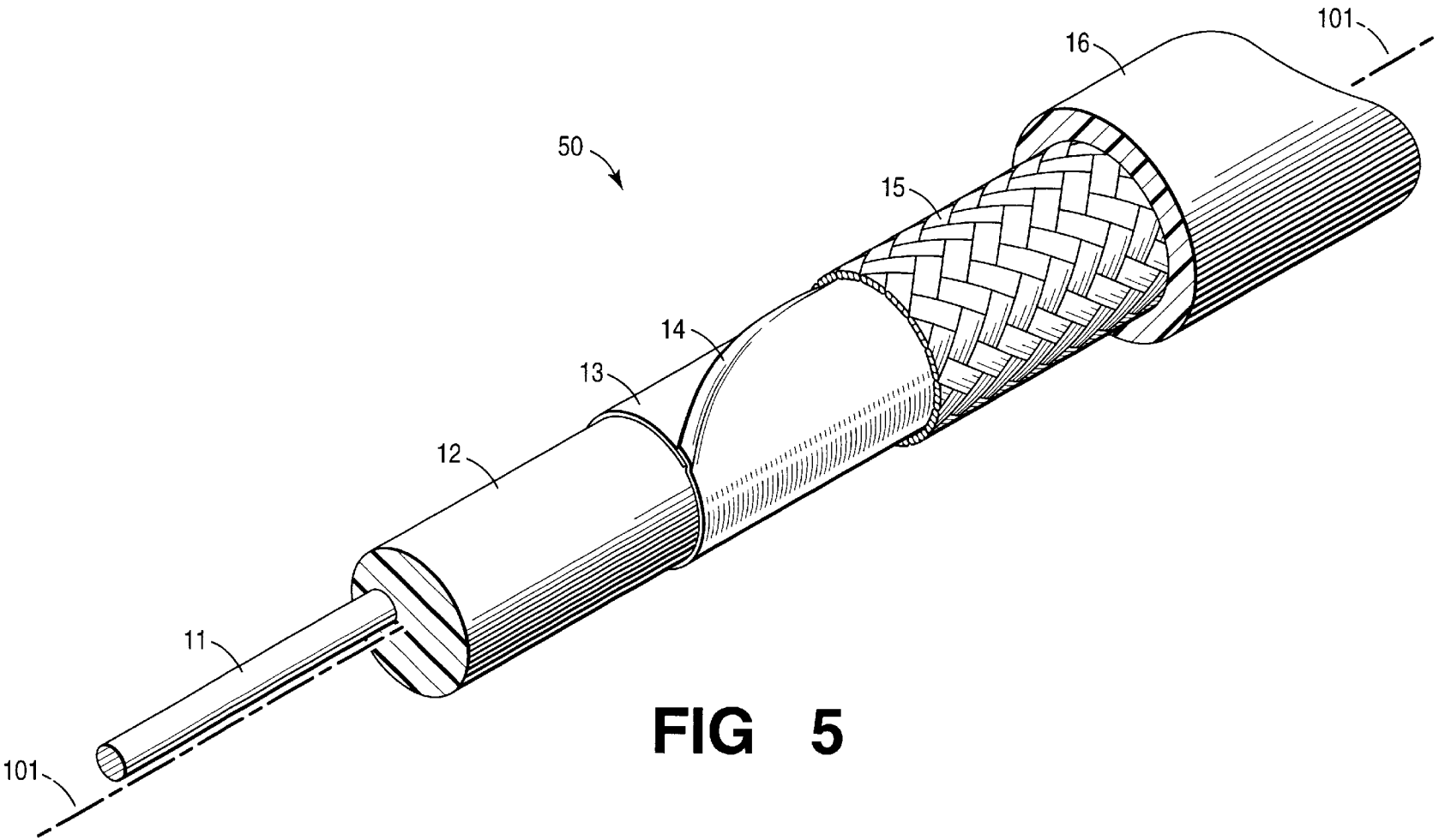
FIG. 5 is a perspective view of a coaxial cable in accordance with a second embodiment of the present invention.

As the diameter of the coaxial cable increases, it becomes more difficult to rotate the insulated conductor itself. However, since it is the relative rotation of the insulated conductor with respect to the outer conductor that provides SRL improvement, rotating the outer conductor around the insulated conductor accomplishes the same result. Accordingly, coaxial cable 50 of FIG. 5 discloses a second embodiment of the present invention in which the outer conductor 13, which illustratively comprises a thin metallic foil, is helically wrapped around a non-rotated insulated conductor structure 11, 12. Similar to FIG. 1, conductor 11 comprises 26 AWG copper wire that is plated with silver, and the layer 12 of insulating material has an outside diameter of about 75 mils (i.e., 1.9 millimeters). Preferably, layer 12 comprises foamed high-density polyethylene. Note that seam 14 constitutes an asymmetry in the outer conductor 13, and that the seam is wrapped around the layer 12 of insulating material to create the same effect as ICR, namely the averaging out of the eccentricity of a conductor 11 within a non-uniform layer of insulation. Braided shield 15 and jacket 16 are similar to the same elements that were discussed in connection with FIG. 1. Preferably, the outer conductor 13 is wrapped around the layer 12 of insulating material once every 5 inches (i.e., 12.7 centimeters). Nevertheless, significant improvement in SRL is available when the outer conductor has a lay length, L, of one meter or more.

In addition to the particular type of sheath system disclosed herein, the materials for the conductor insulation and/or the jacket may be such as to render the cable flame retardant and smoke suppressive. For example, those materials may be fluoropolymers. Underwriters Laboratories has implemented a testing standard for classifying communications cables based on their ability to withstand exposure to heat, such as from building fire. Specifically, cables can be either riser or plenum rated. Illustratively, the UL 910 Flame Test specifies the conditions that cables are subjected to prior to receiving a plenum rating. To achieve such a plenum rating, any number of the known technologies may be incorporated into a cable employing insulated conductor rotation. Additionally, other particular testing standards and/or requirements may be applied and used to qualify cables incorporating the attributes of the present invention depending on the specific environment where the cable will be used.

It is understood that although the above-described coaxial cable design is illustrative of the invention, other designs may be devised by those skilled in the art that embody the principles of the invention. In particular, other insulating materials such as fluorinated ethylene propylene (FEP) are contemplated for use in plenum cable applications; the asymmetry of the outer conductor may be attributable to something other than a seam (for example, a drain wire that is present in the cable may cause the asymmetry); the insulating materials need not be foamed; and the dimensions of the cable need not be as small or as large as the disclosed design. In particular, contemplated uses for the present design include coaxial cables (e.g., RG-6) that are used in cable television (CATV) applications.

What is claimed is:

1. A coaxial cable having length and a longitudinal axis, the cable comprising:

a single inner conductor that extends approximately along the longitudinal axis of the cable, an insulating member that surrounds and encloses the inner conductor to form an insulated conductor, said insulated conductor being axially rotated relative to the longitudinal axis at least one complete rotation of every length, L, of cable;

an outer conductor that surrounds and encloses the insulated conductor; and a jacket of insulating material that surrounds and encloses the outer conductor.

2. The coaxial cable of claim 1 wherein the insulated conductor is rotated around its own longitudinal axis.

3. The coaxial cable of claim 2 wherein the insulated conductor is rotated in a single direction along the length of the coaxial cable.

4. The coaxial cable of claim 2 wherein the insulated conductor is rotated in clockwise and counter-clockwise directions along the length of the coaxial cable.

5. The coaxial cable of claim 2 wherein the rate of rotation of the insulated conductor is varied along the length of the coaxial cable.

6. The coaxial cable of claim 1 wherein the outer conductor comprises a metallic foil that is helically wrapped around the insulated conductor.

7. The coaxial cable of claim 1 wherein the outer conductor includes an asymmetry that extends in the longitudinal direction of the cable.

8. The coaxial cable of claim 7 wherein the asymmetry comprises a seam.

9. The coaxial cable of claim 1 wherein the inner conductor comprises a copper wire.

10. The coaxial cable of claim 1 further including a braided metal shield, which is disposed between the outer conductor and the jacket.

11. The coaxial cable of claim 1 wherein L is less than the shortest wavelength among the signals to be transmitted over the coaxial cable.

12. The coaxial cable of claim 1 wherein L is less than about one meter.

13. The coaxial cable of claim 1 wherein L is less than about 13 centimeters.

14. The coaxial cable of claim 1 wherein the insulating member comprises polyethylene.

15. A coaxial cable that is suitable for the transmission of high frequency electrical signals, said cable having a single wire that extends approximately along a central axis of the cable and is surrounded by a layer of plastic insulating material, the single wire having a longitudinal center perpendicularly displaced an average distance D from said central axis, the cable further including a generally tubular outer conductor, which has an asymmetry that extends in the longitudinal direction of the cable, said insulated wire being axially rotated with respect to the outer conductor such that a locus of points defined by the longitudinal center of said single wire over a length L encircles said central axis when the length L incorporates at least one complete rotation of said insulated wire, said outer conductor being disposed between the insulating material and an outer jacket of the cable.

16. The coaxial cable of claim 15 wherein the relative rotation rate between the insulated wire and the outer conductor is at least one complete rotation for every meter of cable length.

17. The coaxial cable of claim 15 wherein the relative rotation direction between the insulated wire and the outer conductor is uni-directional.

18. The coaxial cable of claim 15 wherein the relative rotation direction between the insulated wire and the outer conductor is bi-directional.

19. The coaxial cable of claim 15 further including a braided-metallic shield that is disposed between the outer conductor and the outer jacket of the cable.

* * * * *